US012168843B2

(12) United States Patent
Potnis et al.

(10) Patent No.: US 12,168,843 B2
(45) Date of Patent: Dec. 17, 2024

(54) HIGHER STRENGTH CALCIUM CARBONATE FILLED FIBER SPUNBOND AND SMS NONWOVEN MATERIAL

(71) Applicant: O&M Halyard, Inc., Mechanicsville, VA (US)

(72) Inventors: Prasad S. Potnis, Johns Creek, GA (US); Jeffrey L. McManus, Canton, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 372 days.

(21) Appl. No.: 17/128,945

(22) Filed: Dec. 21, 2020

(65) Prior Publication Data

US 2022/0195645 A1 Jun. 23, 2022

(51) Int. Cl.

| | |
|---|---|
| ***D04H 1/724*** | (2012.01) |
| ***D04H 1/413*** | (2012.01) |
| ***D04H 1/4291*** | (2012.01) |
| ***D04H 1/4382*** | (2012.01) |
| ***D04H 3/007*** | (2012.01) |
| ***D04H 3/16*** | (2006.01) |

(52) U.S. Cl.

CPC ..... *D04H 3/007* (2013.01); *D04H 1/413* (2013.01); *D04H 1/4291* (2013.01); *D04H 1/43828* (2020.05); *D04H 1/724* (2013.01); *D04H 3/16* (2013.01)

(58) Field of Classification Search

CPC ..... D04H 3/007; D04H 3/16; D04H 1/4291; D04H 1/413; D04H 1/43828; D04H 1/724

See application file for complete search history.

(56) References Cited

U.S. PATENT DOCUMENTS

| | | | |
|---|---|---|---|
| 3,338,992 | A | 8/1967 | Kinney |
| 3,341,394 | A | 9/1967 | Kinney |
| 3,502,538 | A | 3/1970 | Petersem |
| 3,502,763 | A | 3/1970 | Hartman |
| 3,542,615 | A | 11/1970 | Dobo et al. |
| 3,692,618 | A | 9/1972 | Dorschner et al. |
| 3,802,817 | A | 4/1974 | Matsuki et al. |
| 3,849,241 | A | 11/1974 | Butin et al. |
| 4,340,563 | A | 7/1982 | Appel et al. |

(Continued)

FOREIGN PATENT DOCUMENTS

| | | |
|---|---|---|
| WO | WO 00/28123 A1 | 5/2000 |
| WO | WO 2014/011839 A1 | 1/2014 |
| WO | WO 2020/056193 A1 | 3/2020 |

OTHER PUBLICATIONS

International Search Report and Written Opinion for PCT/US2021/063206, dated Apr. 12, 2022, 13 pages.

*Primary Examiner* — Jeremy R Pierce
(74) *Attorney, Agent, or Firm* — Dority & Manning, P.A.

(57) ABSTRACT

A nonwoven web material is formed from fibers including a first polymer, a second polymer and a filler. The first polymer and second polymer may be olefin homopolymers and the filler may be calcium carbonate. The second polymer may have a lower melt flow rate than the first polymer. The fibers are formed in a monocomponent, i.e., monofilament, or multicomponent, e.g., sheath-core bicomponent, arrangement. The nonwoven web material may be used to form an article such as a medical product, a surgical product, a personal protective product, and/or an industrial garment.

15 Claims, 2 Drawing Sheets

(56) References Cited

U.S. PATENT DOCUMENTS

| | | | | |
|---|---|---|---|---|
| 4,937,299 | A | 6/1990 | Ewen et al. | |
| 5,218,071 | A | 6/1993 | Tsutsui et al. | |
| 5,272,236 | A | 12/1993 | Lai et al. | |
| 5,278,272 | A | 1/1994 | Lai et al. | |
| 5,322,728 | A | 6/1994 | Davey et al. | |
| 5,382,400 | A | 1/1995 | Pike et al. | |
| 5,472,775 | A | 12/1995 | Obijeski et al. | |
| 5,539,056 | A | 7/1996 | Yang et al. | |
| 5,571,619 | A | 11/1996 | McAlpin et al. | |
| 5,596,052 | A | 1/1997 | Resconi et al. | |
| 6,090,325 | A | 7/2000 | Wheat et al. | |
| 6,100,208 | A * | 8/2000 | Brown | D04H 1/5412 442/396 |
| 6,500,563 | B1 | 12/2002 | Datta et al. | |
| 11,390,972 | B2 * | 7/2022 | Potnis | D04H 3/16 |
| 2004/0121135 | A1 * | 6/2004 | Hurley | D04H 1/49 428/221 |
| 2006/0292954 | A1 * | 12/2006 | Suzuka | D04H 3/14 442/345 |
| 2007/0122614 | A1 * | 5/2007 | Peng | D01F 8/06 428/374 |
| 2009/0104831 | A1 * | 4/2009 | Bornemann | D04H 3/007 442/417 |
| 2014/0018759 | A1 * | 1/2014 | Jayasinghe | B32B 27/12 442/328 |
| 2015/0017865 | A1 | 1/2015 | Schröer et al. | |
| 2015/0017866 | A1 * | 1/2015 | Schroer | D04H 3/005 442/361 |

* cited by examiner

HIGHER STRENGTH CALCIUM CARBONATE FILLED FIBER SPUNBOND AND SMS NONWOVEN MATERIAL

FIELD OF THE INVENTION

The subject matter of the present invention relates generally to a nonwoven web material that can be used in medical products, surgical products, personal protective products, industrial garments, and the like.

BACKGROUND

Nonwoven fabric laminates are useful for a wide variety of applications. Such nonwoven fabric laminates are useful for wipers, towels, industrial garments, medical garments, medical drapes, and the like. Disposable fabric laminates have achieved especially widespread use in hospital operating rooms for drapes, gowns, towels, foot covers, sterile wraps, and the like. Such surgical fabric laminates are generally spun-bonded/melt-blown/spun-bonded (SMS) laminates having of nonwoven outer layers of spun-bonded polypropylene and an interior barrier layer of melt-blown polypropylene.

Current spunbond webs used in the manufacture of medical fabric laminates, e.g., for sterilization materials and/or protective garments, drapes and/or wraps, are formed from a polymer or polymer blend requiring relatively high amounts of additives such as titanium dioxide and color pigments. While such a spunbond web has advantages, significant improvements can be made in reducing the amount of additives required. Importantly, improved characteristics with respect to strength of the nonwoven web without compromising other characteristics, e.g., weight, softness, of the spunbond web.

It is therefore an object of the present invention to provide a nonwoven web formed from a fiber including a calcium carbonate filler to reduce the polymer content of the fiber without compromising the characteristics of the nonwoven web.

SUMMARY

Objects and advantages of the invention will be set forth in part in the following description, or may be obvious from the description, or may be learned through practice of the invention.

The present invention is directed to an article including a nonwoven web material. The nonwoven web material includes fibers, wherein the fibers include a first polymer, a second polymer and a filler. The first polymer is a polyolefin, the second polymer is a polyolefin having a lower melt flow rate (MFR) than the first polymer, and the filler is calcium carbonate ($CaCO_3$). The article includes a medical product, a surgical product, a personal protective product, and/or an industrial garment.

In one particular embodiment, the first polymer can be a polypropylene, and the second polymer can be a polypropylene having a lower MFR than the first polymer.

In another embodiment, the filler can be present in the fibers in an amount in a range from about 0.5 wt. percent to about 30 wt. percent based on the total weight of the fibers.

In an additional embodiment, the filler can be present in the fibers in an amount of in a range from about 1 wt. percent to about 20 wt. percent based on the total weight of the fibers.

In a further embodiment, the filler can be present in the fibers in an amount of in a range from about 2 wt. percent to about 15 wt. percent based on the total weight of the fibers.

In yet another embodiment, the fibers can be bicomponent fibers having a sheath-core arrangement comprising a sheath and a core. Further, the sheath can include the first polymer. Moreover, the core may be free from the first polymer. Further, the core can include the second polymer. Moreover, the filler may be present in the sheath and/or the core. For instance, the filler can be present in both the sheath and the core. Moreover, the core can further include the second polymer. Furthermore, the sheath can further include at least one pigment.

In an additional embodiment, the fibers can further include titanium dioxide ($TiO_2$) and at least one pigment. Further, the titanium dioxide can be present in an amount greater than 0 wt. percent and less than or equal to about 0.2 wt. percent based on the total weight of the fibers.

In still another embodiment, the fibers can be monofilaments. Further, the second polymer can be present in an amount in a range from about 10 wt. percent to about 90 wt. percent based on the total weight of polymer in the fibers.

In a further embodiment, the nonwoven web material can have a tensile strength greater than about 7000 grams-force.

In another embodiment, the nonwoven web material may be formed as at least one layer of a laminate material.

In an additional embodiment, the medical product, surgical product, personal protective product, and/or industrial garment can be a sterilization material.

In still another embodiment, the medical product, surgical product, personal protective product, and/or industrial garment can be a personal protective garment.

In one more embodiment, the calcium carbonate mean particle size may be in a range from about 0.5 microns to about 20 microns.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
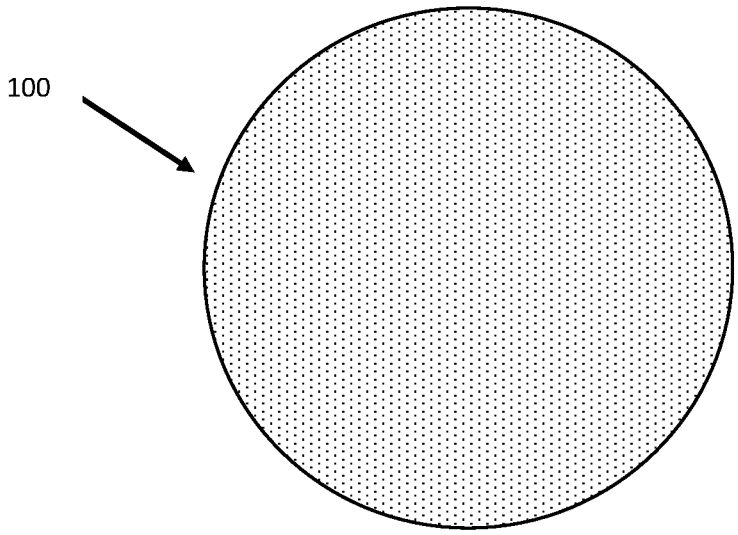
FIG. 1 illustrates a cross-sectional view of a monocomponent fiber made according to one particular embodiment of the present invention.
Figure 2:
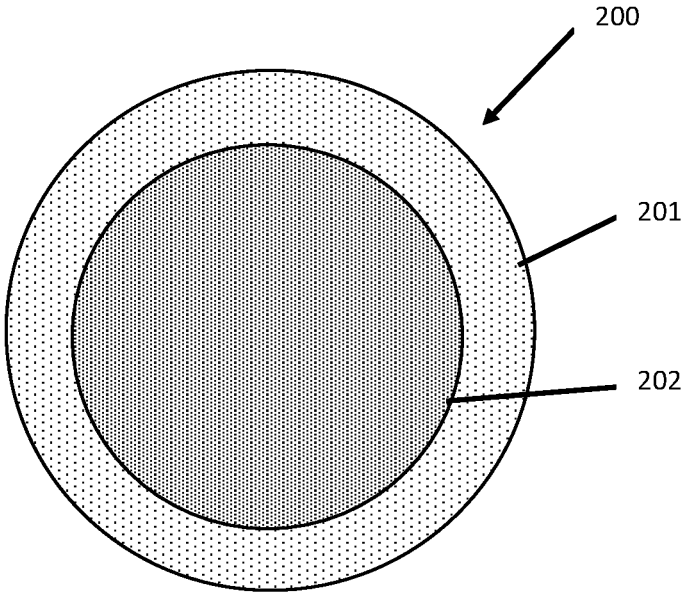
FIG. 2 illustrates a cross-sectional view of a multicomponent fiber made according to an embodiment of the present invention.
Figure 3:
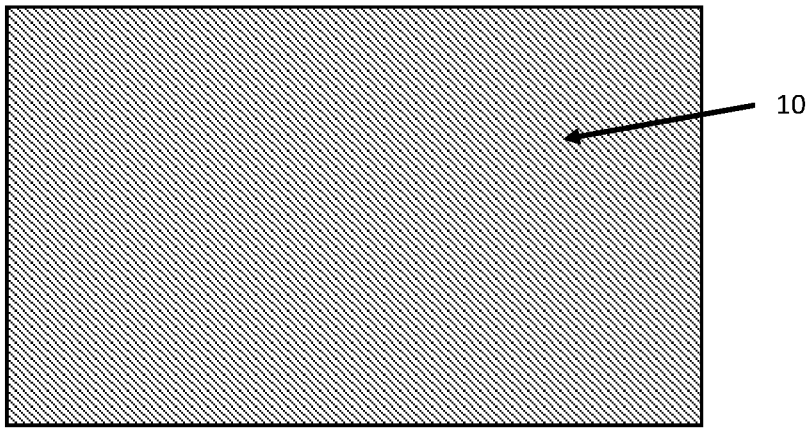
FIG. 3 illustrates an article formed from the nonwoven material of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "about," "approximately," or "generally," when used to modify a value, indicates that the value can be raised or lowered by 5% and remain within the disclosed embodiment. Further, when a plurality of ranges are provided, any combination of a minimum value and a maximum value described in the plurality of ranges are contemplated by the present invention. For example, if ranges of "from about 20% to about 80%" and "from about 30% to about 70%" are described, a range of "from about 20% to about 70%" or a range of "from about 30% to about 80%" are also contemplated by the present invention.

As used herein the term "nonwoven web" generally refers to a web having a structure of individual fibers or threads which are interlaid, but not in an identifiable manner as in a knitted fabric. Examples of suitable nonwoven fabrics or webs include, but are not limited to, meltblown webs, spunbond webs, bonded carded webs, airlaid webs, coform webs, hydraulically entangled webs, and so forth.

As used herein, the term "meltblown web" generally refers to a nonwoven web that is formed by a process in which a molten thermoplastic material is extruded through a plurality of fine, usually circular, die capillaries as molten fibers into converging high velocity gas (e.g., air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin, et al., which is incorporated herein in its entirety by reference thereto for all purposes. Generally speaking, meltblown fibers may be microfibers that are substantially continuous or discontinuous, generally smaller than 10 microns in diameter, and generally tacky when deposited onto a collecting surface.

As used herein, the term "spunbond web" generally refers to a web containing small diameter substantially continuous fibers. The fibers are formed by extruding a molten thermoplastic material from a plurality of fine, usually circular, capillaries of a spinnerette with the diameter of the extruded fibers then being rapidly reduced as by, for example, eductive drawing and/or other well-known spunbonding mechanisms. The production of spunbond webs is described and illustrated, for example, in U.S. Pat. No. 4,340,563 to Appel, et al., U.S. Pat. No. 3,692,618 to Dorschner, et al., U.S. Pat. No. 3,802,817 to Matsuki, et al., U.S. Pat. No. 3,338,992 to Kinney, U.S. Pat. No. 3,341,394 to Kinney, U.S. Pat. No. 3,502,763 to Hartman, U.S. Pat. No. 3,502,538 to Petersen, U.S. Pat. No. 3,542,615 to Dobo, et al., and U.S. Pat. No. 5,382,400 to Pike, et al., which are incorporated herein in their entirety by reference thereto for all purposes. Spunbond fibers are generally not tacky when they are deposited onto a collecting surface. Spunbond fibers may sometimes have diameters less than about 40 microns, and are often between about 5 to about 20 microns.

As used herein, the terms "machine direction" or "MD" generally refers to the direction in which a material is produced. The term "cross-machine direction" or "CD" refers to the direction perpendicular to the machine direction.

Generally speaking, the present invention is directed to a nonwoven web material that can be used in a sterilization or medical protective application, such as a protective surgical garment, drape or wrap. The nonwoven web material can be formed from fibers containing one or more polymers. The fibers can be microfibers, nanofibers, or any other fiber suitable for use in a nonwoven web material. The fibers can also contain a calcium carbonate filler and one or more additives such as color pigment. In some embodiments, the one or more polymers may be a higher-melt flow rate polymer and a lower-melt flow rate polymer. Without intending to be bound by any particular theory, the present inventors have found that fibers formed from a higher-melt flow rate polymer and a lower-melt flow rate polymer in addition to a calcium carbonate filler have improved strength characteristics while maintaining a consistent basis weight and other characteristics. In addition, the present inventors have found that fibers formed from a higher-melt flow rate polymer and a lower-melt flow rate polymer in addition to a calcium carbonate filler require a smaller relative percentage of additives such as titanium dioxide and color pigment compared to existing alternatives, as the calcium carbonate filler can dull the appearance of the fibers, replacing much of the titanium dioxide. In this regard, various embodiments of the present invention will now be described in more detail.

Exemplary polymers that can be used in forming the nonwoven web material 10 of the present invention can include olefins (e.g., polypropylenes and polyethylenes), polyesters (e.g., polyethylene terephthalate, polybutylene terephthalate), polyamides (e.g., nylons), polycarbonates, polyphenylene sulfides, polystyrenes, polyurethanes (e.g., thermoplastic polyurethanes), etc. In one particular embodiment, the fibers of the nonwoven web material can include an olefin homopolymer. One suitable olefin homopolymer is a polypropylene homopolymer having a density of about 0.9 grams per cubic centimeter, a melt flow rate of about 35 g/10 minute (230° C., 2.16 kg), and is available as ExxonMobil™ 3155E5, available from ExxonMobil Chemical Company of Houston, Texas Another suitable olefin homopolymer is a polypropylene homopolymer having a density of about 0.9 grams per cubic centimeter, a melt flow rate of about 15 g/10 minute (230° C., 2.16 kg), and a melting temperature of 151° C., and is available as TOTAL LUMICENE® Polypropylene MR 2002 metallocene polypropylene, or M3661 metallocene polypropylene having a melt flow rate of about 14 MFR, both available from Total Petrochemicals. Additionally, the fibers of the nonwoven web material can include an olefin copolymer.

Any of a variety of known techniques may generally be employed to form the polyolefins. For instance, olefin polymers may be formed using a free radical or a coordination catalyst (e.g., Ziegler-Natta or metallocene). Metallocene-catalyzed polyolefins are described, for instance, in U.S. Pat. No. 5,571,619 to McAlpin et at; U.S. Pat. No. 5,322,728 to Davey, et al.; U.S. Pat. No. 5,472,775 to Obijeski et al.; U.S. Pat. No. 5,272,236 to Lai et al.; and U.S. Pat. No. 6,090,325 to Wheat, et al., which are incorporated herein in their entirety by reference thereto for all purposes. Examples of metallocene catalysts include bis(n-butylcyclopentadienyl) titanium dichloride, bis(n-butylcyclopentadienyl)zirconium dichloride, bis(cyclopentadienyl)scandium chloride, bis(indenyl)zirconium dichloride, bis(methylcyclopentadienyl)titanium dichloride, bis(methylcyclopentadienyl)zirconium dichloride, cobaltocene, cyclopentadienyltitanium trichloride, ferrocene, hafnocene dichloride, isopropyl(cyclopentadienyl,-1-flourenyl)zirconium dichloride, molybdocene dichloride, nickelocene, niobocene dichloride, ruthenocene, titanocene dichloride, zirconocene chloride hydride, zirconocene dichloride, and so forth. Polymers made using metallocene catalysts typically have a narrow molecular weight range. For instance, metallocene-catalyzed polymers may have polydispersity numbers ($M_w/M_n$) of below 4, controlled short chain branching distribution, and controlled isotacticity.

The melt flow rate (MFR) of the polyolefins may generally vary, but is typically in the range of about 0.1 grams per 10 minutes to about 100 grams per 10 minutes, in some embodiments from about 5 grams per 10 minutes to about 50 grams per 10 minutes, and in some embodiments, about 10 to about 40 grams per 10 minutes, determined at 230° C. The melt flow index is the weight of the polymer (in grams) that may be forced through an extrusion rheometer orifice (0.0825-inch diameter) when subjected to a force of 2160 grams in 10 minutes at 230° C., and may be determined in accordance with ISO 1133.

In some embodiments, the fibers of the present invention can be formed from a semi-crystalline polyolefin. Exemplary polyolefins may include, for instance, polypropylene, polyethylene, blends and copolymers thereof. Suitable propylene polymers may include, for instance, polypropylene homopolymers, as well as copolymers or terpolymers of propylene with an α-olefin (e.g., $C_3$-$C_{20}$) comonomer, such as ethylene, 1-butene, 2-butene, the various pentene isomers, 1-hexene, 1-octene, 1-nonene, 1-decene, 1-unidecene, 1-dodecene, 4-methyl-1-pentene, 4-methyl-1-hexene, 5-methyl-1-hexene, vinylcyclohexene, styrene, etc. The comonomer content of the propylene polymer may be about 35 wt. % or less, in some embodiments from about 1 wt. % to about 20 wt. %, in some embodiments, from about 2 wt. % to about 15 wt. %, and in some embodiments from about 3 wt. % to about 10 wt. %. The density of the polypropylene (e.g., propylene/α-olefin copolymer) may be 0.95 grams per cubic centimeter (g/cm$^3$) or less, in some embodiments, from 0.85 to 0.92 g/cm$^3$, and in some embodiments, from 0.85 g/cm$^3$ to 0.91 g/cm$^3$. In one particular embodiment, the spunbond layers can each include a copolymer of polypropylene and polyethylene.

Suitable propylene polymers are commercially available under the designations VISTAMAXX™ from ExxonMobil Chemical Co. of Houston, Texas; FINA™ (e.g., 8573) from Atofina Chemicals of Feluy, Belgium; TAFMER™ available from Mitsui Petrochemical Industries; and VERSIFY™ available from Dow Chemical Co. of Midland, Michigan Additional suitable polypropylene polymers include random copolymers such as Total Random Copolymer M8660 available from Total Polymers. Other examples of suitable propylene polymers are described in U.S. Pat. No. 6,500,563 to Datta, et al.; U.S. Pat. No. 5,539,056 to Yang, et al.; and U.S. Pat. No. 5,596,052 to Resconi, et al., which are incorporated herein in their entirety by reference thereto for all purposes.

In some embodiments, the spunbond layers can be formed from a semi-crystalline polyolefin. Exemplary polyolefins may include, for instance, polypropylene, polyethylene, blends and copolymers thereof.

Of course, the olefin(s) of the fibers of the present invention are by no means limited to propylene polymers. For instance, ethylene polymers may also be suitable for use as a semi-crystalline polyolefin. In one particular embodiment, a polyethylene is employed that is a copolymer of ethylene and an α-olefin, such as a $C_3$-$C_{20}$ α-olefin or $C_3$-$C_{12}$ α-olefin. Suitable α-olefins may be linear or branched (e.g., one or more $C_1$-$C_3$ alkyl branches, or an aryl group). Specific examples include 1-butene; 3-methyl-1-butene; 3,3-dimethyl-1-butene; 1-pentene; 1-pentene with one or more methyl, ethyl or propyl substituents; 1-hexene with one or more methyl, ethyl or propyl substituents; 1-heptene with one or more methyl, ethyl or propyl substituents; 1-octene with one or more methyl, ethyl or propyl substituents; 1-nonene with one or more methyl, ethyl or propyl substituents; ethyl, methyl or dimethyl-substituted 1-decene; 1-dodecene; and styrene. Particularly desired α-olefin co-monomers are 1-butene, 1-hexene and 1-octene. The ethylene content of such copolymers may be from about 60 mole % to about 99 mole %, in some embodiments from about 80 mole % to about 98.5 mole %, and in some embodiments, from about 87 mole % to about 97.5 mole %. The α-olefin content may likewise range from about 1 mole % to about 40 mole %, in some embodiments from about 1.5 mole % to about 15 mole %, and in some embodiments, from about 2.5 mole % to about 13 mole %.

The density of the polyethylene may vary depending on the type of polymer employed, but generally ranges from 0.85 to 0.96 grams per cubic centimeter ("g/cm$^3$"). Polyethylene "plastomers", for instance, may have a density in the range of from 0.85 to 0.91 g/cm$^3$. Likewise, "linear low density polyethylene" ("LLDPE") may have a density in the range of from 0.91 to 0.940 g/cm$^3$; "low density polyethylene" ("LDPE") may have a density in the range of from 0.910 to 0.940 g/cm$^3$; and "high density polyethylene" ("HDPE") may have density in the range of from 0.940 to 0.960 g/cm$^3$. Densities may be measured in accordance with ASTM 1505. Particularly suitable ethylene-based polymers for use in the present invention may be available under the designation EXACT™ from ExxonMobil Chemical Company of Houston, Texas Other suitable polyethylene plastomers are available under the designation ENGAGE™ and AFFINITY™ from Dow Chemical Company of Midland, Michigan Still other suitable ethylene polymers are available from The Dow Chemical Company under the designations DOWLEX™ (LLDPE) and ATTANE™ (ULDPE). Other suitable ethylene polymers are described in U.S. Pat. No. 4,937,299 to Ewen et al.; U.S. Pat. No. 5,218,071 to Tsutsui et al.; U.S. Pat. No. 5,272,236 to Lai et al.; and U.S. Pat. No. 5,278,272 to Lai, et al., which are incorporated herein in their entirety by reference thereto for all purposes.

The melt flow rate (MFR) of the polyolefins may generally vary, but is typically in the range of about 0.1 grams per 10 minutes to about 100 grams per 10 minutes, in some embodiments from about 0.5 grams per 10 minutes to about 30 grams per 10 minutes, and in some embodiments, about 1 to about 10 grams per 10 minutes, determined at 190° C. The melt flow rate is the weight of the polymer (in grams) that may be forced through an extrusion rheometer orifice (0.0825-inch diameter) when subjected to a force of 2160 grams in 10 minutes at 190° C., and may be determined in accordance with ASTM Test Method D1238-E.

Any of the semi-crystalline polyolefins discussed above can be used to form a spunbond or a meltblown nonwoven web, e.g., to form a spunbond and/or a meltblown layer of a laminate material.

The fibers of the nonwoven web further include calcium carbonate ($CaCO_3$) as a filler. The calcium carbonate filler has characteristics, e.g., sufficiently small particle size, that enable it to be incorporated with the polymer(s) of the fiber of the present invention and spun into a spunbond material. For instance, the calcium carbonate mean particle size may be in a range from about 0.5 microns to about 20 microns, such as from about 1 micron to about 8 microns, e.g. from about 1.5 microns to about 2 microns. A specific calcium carbonate filler that can be used is FiberMaxx SCC 89695.

The calcium carbonate filler can be present in an amount in a range from about 1 weight percent (wt. %) to about 30 wt. % based on the total weight of the fibers. For instance, the calcium carbonate filler can be present in an amount in a range between about 2 wt. % and about 20 wt. % calcium carbonate based on the total weight of the fibers. In some particular embodiments, the mineral filler can be present in an amount of about 5 wt. %, or about 10 wt. %, or about 15 wt. %, based on the total weight of the fibers. The calcium carbonate filled polymer fibers have been shown to provide enhanced spinnability/draw-ability when the fibers are used in a spunbond process while maintaining key physical properties, such as tensile strength.

In addition to the polyolefin and calcium carbonate filler, the fiber can also include one or more additives such as a nucleating agent. The nucleating agent can be titanium dioxide (e.g., SCC 4837 $TiO_2$). The titanium dioxide can be present in an amount ranging from about 0.01 wt. % to about 1 wt. %, such as from about 0.05 wt. % to about 0.5 wt. %, for instance in some embodiments about 0.1 wt. %, based on the total weight of the fiber.

If the nonwoven material formed from the fibers of the present invention is desired to have light-scattering and light-absorbing properties, e.g., to reduce glare of the fibers which can have a shiny appearance, one or more additives having light-absorbing and light-scattering properties may be included in the fiber. For example, when fibers including additives having light-absorbing and light-scattering properties are used to form a nonwoven material 10, the nonwoven material 10 may be imparted with anti-glare and light reflectance properties. For example, if the nonwoven material 10 is used to form a surgical product, the anti-glare and light-reflectance properties of the nonwoven material 10 can provide a better visual field during surgeries or other procedures where operating room lighting can result in poor visual conditions, resulting in glare that causes visual discomfort, and leads to fatigue of operating room staff during surgical procedures.

Titanium dioxide is often used in fibers of existing nonwoven materials to reduce glare, e.g., in amounts up to about 10 wt. %. However, titanium dioxide is a very strong whitening agent, and a significant amount of color pigment must be used in order to overcome the whitening effect of the titanium dioxide in order to achieve a desired color. The present inventors have found that the calcium carbonate filler in the fiber of the present invention has similar light-scattering and light-absorbing properties without the whitening effect of titanium dioxide.

In addition to the polyolefin and calcium carbonate filler, the fiber can also include one or more additives such as one or more pigments to help achieve a desired color and/or enhance the light-absorbing properties of the nonwoven web. Examples of suitable pigments include, but are not limited to, a color pigment such as a blue pigment (e.g., SCC 11175). The pigment can be present in an amount ranging from about 0.05 wt. % to about 1 wt. % based on the total weight of the fiber, such as from about 0.1 wt. % to about 0.8 wt. %, and in some embodiments, from about 0.2 wt. % to about 0.75 wt. % based on the total weight of the fiber. The present inventors have found that, when the fiber includes the calcium carbonate filler in addition to the polyolefin, a smaller quantity of titanium dioxide is required because the calcium carbonate has similar light-scattering and light-absorbing properties. In turn, a smaller relative quantity of pigment is necessary in the fiber to achieve the desired color and/or light absorbing properties, because calcium carbonate does not have the whitening effect of titanium dioxide. This may have the added benefit of reducing cost of manufacturing the fiber and/or nonwoven materials of the present invention by reducing the total amount of titanium dioxide and pigment(s) included in the formulation of the fiber.

Each of the components as described above can be combined to form a polymer blend, from which monofilaments 100 may be formed, e.g., in a spunbonding process, to form at least one layer of a nonwoven material 10. In some embodiments in which the polymer blend is formed into a monofilament 100, the second polymer is present in an amount in a range from about 10 wt. percent to about 90 wt. percent based on the total weight of polymer in the fibers (e.g., the total combined weight of the first polymer and the second polymer). Moreover, the calcium carbonate filler can be present in the monofilament 100 in an amount in a range from about 0.5 wt. % to about 30 wt. %, such as from about 1 wt. % to about 20 wt. %, for example from about 2 wt. % to about 15 wt. %, based on the total weight of the monofilament 100.

In additional embodiments, the fibers from which the nonwoven web material is formed can be multicomponent fibers 200, e.g., bicomponent, and can have a sheath-core arrangement formed by a sheath 201 and a core 202.

For instance, in some embodiments, the fibers 200 from which the nonwoven web material is formed can have a sheath-core arrangement where the sheath 201 can include from about 75 wt. % to about 99 wt. %, such as from about 80 wt. % to about 99 wt. %, such as from about 90 wt. % to about 95 wt. % of an olefin homopolymer (e.g., polypropylene) based on the total weight of the sheath component of the multicomponent fiber. The sheath 201 can further include from about 0.1 wt. % to about 1 wt. %, such as from about 0.2 wt. % to about 0.8 wt. %, and in some embodiments, from about 0.5 wt. % to about 0.75 wt. %, of a pigment based on the total weight of the sheath component of the multicomponent fiber, and from about 0.01 wt. % to about 1 wt. %, such as from about 0.05 wt. % to about 0.5 wt. %, for instance in some embodiments about 0.1 wt. %, of titanium dioxide based on the total weight of the sheath component of the multicomponent fiber. Meanwhile, the sheath can also include from about 1 wt. % to about 25 wt. %, such as from about 3 wt. % to about 20 wt. %, such as from about 5 wt. % to about 15 wt. % of calcium carbonate filler based on the total weight of the sheath component of the multicomponent fiber.

In addition, the core 202 can include from about 75 wt. % to about 100 wt. %, such as from about 80 wt. % to about 95 wt. %, such as from about 85 wt. % to about 95 wt. %, of an olefin homopolymer (e.g., polypropylene) based on the total weight of the core component of the multicomponent fiber. Further, the core can include from about 0 wt. % to about 25 wt. %, such as from about 5 wt. % to about 20 wt. %, such as from about 5 wt. % to about 15 wt. % of calcium carbonate filler based on the total weight of the core component of the fiber.

For instance, in a sheath-core multicomponent fiber arrangement, the sheath 201 can include a sheath polymer blend and the core 202 can include a core polymer blend. The sheath polymer blend and the core polymer blend can be different from each other. For instance, the sheath polymer blend may include a first olefin polymer, and the core polymer blend may include a second olefin polymer. The first olefin polymer may have a higher MFR than the second olefin polymer. For instance, the first polymer may be a polypropylene homopolymer having a MFR of about 35 g/10 minute (230° C., 2.16 kg) and the second polymer may be a polypropylene homopolymer having a MFR of about 15 g/10 minute (230° C., 2.16 kg). The higher melt flow rate polymer, i.e., the first polymer, can be used in at least the sheath layer of a sheath-core multicomponent fiber to help the thermal bonding of the filaments of the nonwoven spunbond web without an impact on the polymers of the core layer. Thus, the filament strength can be maintained while also achieving improved thermal bonding capabilities when the fibers are formed into a nonwoven web in a spunbonding process. Additionally or alternatively, the sheath polymer blend can include a polypropylene random copolymer having a higher MFR than the second olefin polymer, as such a polypropylene random copolymer has beneficial bonding and softness properties. For instance, the polypropylene random copolymer can be in a blend with the first olefin polymer in an amount between about 0 wt. % and 100 wt. % based on the total amount of the first olefin polymer in the sheath polymer blend. That is to say, in some embodiments the polypropylene random copolymer can replace the polypropylene homopolymer as the first olefin polymer, or the polypropylene homopolymer and the polypropylene random copolymer can be blended in the sheath polymer blend in any desired proportions.

In some embodiments, the calcium carbonate filler may present in only the sheath 201 of a sheath-core multicomponent fiber 200, and the core 202 can include 100% of a polymer such as an olefin homopolymer as described above. In other embodiments, the calcium carbonate filler may be present in both the sheath layer 201 and the core layer 202 of a sheath-core multicomponent fiber 200. For instance, the calcium carbonate filler can be combined with the first polymer as described above to form the sheath 201, and the calcium carbonate filler can be combined with the second polymer as described above to form the core 202.

When the fiber is formed as a sheath-core multicomponent fiber 200, the additives such as titanium dioxide and/or one or more pigments can be included in the sheath 201. For instance, the core 202 can be free from the one or more pigments. Additionally, the core 202 may be free from additives other than the polymer(s) and calcium carbonate filler described above. In such an arrangement, the total amount of titanium dioxide and/or one or more pigments in a sheath-core multicomponent fiber can be less than the total amount of titanium dioxide and/or one or more pigments needed to form a comparable monocomponent (i.e., monofilament) fiber 100 having similar color and strength characteristics.

Further, the weight percentage of the sheath 201 can range from about 5 wt. % to about 50 wt. %, such as from about 10 wt. % to about 30 wt. %, for instance, about 20 wt. %, based on the total weight of the fiber 200. Meanwhile, the weight percentage of the core 202 can range from about 50 wt. % to about 95 wt. %, such as from about 70 wt. % to about 90 wt. %, based on the total weight of the fiber 200.

The present inventors have found that the addition of a lower-MFR olefin polymer to a higher-MFR olefin polymer a calcium carbonate filler may make up the loss of strength that occurs from adding the calcium carbonate filler to the higher-MFR olefin polymer, as shown in the Example below. Moreover, the fibers of the present invention including the lower-MFR olefin polymer, the higher-MFR olefin polymer and the calcium carbonate filler may actually increase the strength of the fibers as compared to fibers that are free of the lower-MFR olefin polymer. In particular, including the lower-MFR olefin polymer in the core layer 202 of a sheath-core fiber 200 may result in the greatest increase in strength of the fibers. Moreover, a blend of the lower-MFR olefin polymer and the calcium carbonate filler in the core layer 202 of a sheath-core fiber 200 may enable a reduction in the total relative amount of polymer, by fiber weight, needed to make the fiber 200. Thereby, some cost savings may be achieved by adding calcium carbonate filler to the core layer 201 without sacrificing strength of the fiber 200.

Regardless of the specific polymer or polymers and additives used to form the monofilament 100 or multicomponent 200 fibers of the nonwoven web as described above, the nonwoven web 10 can have a basis weight ranging from about 5 gsm to about 50 gsm, such as from about 10 gsm to about 40 gsm, such as from about 15 gsm to about 30 gsm. In one particular embodiment, the nonwoven web2 can have a basis weight of about 26 gsm (about 0.75 osy).

The nonwoven web of the present invention can be used to form a nonwoven material 10, e.g., a nonwoven laminate material, that can be used in a variety of applications. In particular, the nonwoven web 10 of the present invention can be used to form at least one layer of a disposable fabric laminate for medical and/or surgical products, such as drapes, gowns, towels, foot covers or other disposable medical garments. The nonwoven web 10 can be used to form a sterilization material, such as a sterilization wrap, configured to allow sterilization of contents wrapped within the sterilization material and maintain a sterile barrier, e.g., for surgical or medical uses. The nonwoven web 10 can further be used to form other personal protective equipment, such as protective headwear, masks, garments, e.g., sterile clean room garments or foot covers, industrial garments or foot covers, or the like. The nonwoven material 10 can be used to form additional products such as wipers, towels, incontinence products, personal hygiene products (e.g., feminine hygiene products, diapers, and the like), baby and childcare products, wound care products, and the like. For instance, the nonwoven web of the present invention can be used to form one or more layers of a spunbond-meltblown-spunbond (SMS) laminate material. In some embodiments, the SMS laminate material can include a first spunbond layer and a second spunbond layer with at least one meltblown layer disposed therebetween. For instance, in one particular embodiment, the nonwoven material can be formed can be a SSMMMS (i.e., spunbond-spunbond-meltblown-meltbown-meltblown-spunbond) material, in which one or more of the spunbond layers are formed as fibers 100 or 200 of the present invention having the higher-MFR polyolefin, the lower-MFR polyolefin and the calcium carbonate filler.

EXAMPLES

Spunbond nonwoven web sampled as described below were prepared and then tested for their tensile strength along both the machine direction (MD) and cross direction (MD) to calculate an average tensile strength, as shown in Table 1 below. Each sample was prepared as a sheath-core bicomponent fiber. The samples were prepared by compounding each of the components of the sheath and the core, respectively, then extruding the components into a bicomponent fiber, and forming a spunbond web from the fibers. As described below, with some of the fibers, namely, the Control, Sample 1 and Sample 2, the sheath layer and the core layer were formed from identical compositions, such that the fibers may mimic a monofilament formed from each respective composition.

Control: Sheath-core bicomponent fiber having a sheath: core ratio of 20:80, where both the sheath layer and the core layer are formed from 98.28 wt. % polypropylene homopolymer having a MFR of about 35 g/10 min. available as ExxonMobil™ 3155E5; 0.90 wt. % titanium dioxide (SCC 4837); and 0.82 wt. % blue pigment (SCC 11175).

Sample 1: Sheath-core bicomponent fiber having a sheath: core ratio of 20:80, where both the sheath layer and the core layer are formed from 94.3 wt. % polypropylene homopolymer having a MFR of about 35 g/10 min. available as ExxonMobil™ 3155E5; 5.0 wt. % calcium carbonate filler (FiberMaxx SCC 89695); 0.10 wt. % titanium dioxide (SCC 4837); and 0.6 wt. % blue pigment (SCC 11175).

Sample 2: Sheath-core bicomponent fiber having a sheath: core ratio of 20:80, where both the sheath layer and the core layer are formed from 94.3 wt. % polypropylene homopolymers; 5.0 wt. % calcium carbonate filler (FiberMaxx SCC 89695); 0.10 wt. % titanium dioxide (SCC 4837); and 0.6 wt. % blue pigment (SCC 11175). The polypropylene homopolymer composition is formed from an 20:80 ratio of a polypropylene homopolymer having a MFR of about 35 g/10 min. available as ExxonMobil™ 3155E5 and a polypropylene homopolymer having a MFR of about 15 g/10 min. (TOTAL LUMICENE® Polypropylene MR 2002).

Sample 3: Sheath-core bicomponent fiber having a sheath: core ratio of 20:80. The sheath is formed from 94.3 wt. % polypropylene homopolymer having a MFR of about 35 g/10 min. available as ExxonMobil™ 3155E5; 5.0 wt. % calcium carbonate filler (FiberMaxx SCC 89695); 0.10 wt. % titanium dioxide (SCC 4837); and 0.6 wt. % blue pigment (SCC 11175). The core is formed from 100% polypropylene homopolymer having a MFR of about 15 g/10 min. (TOTAL LUMICENE® Polypropylene MR 2002).

Sample 4: A sheath-core bicomponent fiber identical to that of Sample 3 but having a sheath:core ratio of 30:70.

Sample 5: A sheath-core bicomponent fiber identical to that of Sample 3 but having a sheath:core ratio of 50:50.

Sample 6: Sheath-core bicomponent fiber having a sheath: core ratio of 20:80. The sheath is formed from 94.3 wt. % polypropylene homopolymer having a MFR of about 35 g/10 min. available as ExxonMobil™ 3155E5; 5.0 wt. % calcium carbonate filler (FiberMaxx SCC 89695); 0.10 wt. % titanium dioxide (SCC 4837); and 0.6 wt. % blue pigment (SCC 11175). The core is formed from 95 wt. % polypropylene homopolymer having a MFR of about 15 g/10 min. (TOTAL LUMICENE® Polypropylene MR 2002); 5 wt. % calcium carbonate filler (FiberMaxx SCC 89695).

Sample 7: A sheath-core bicomponent fiber identical to that of Sample 6 but having a sheath:core ratio of 30:70.

Sample 8: A sheath-core bicomponent fiber identical to that of Sample 6 but having a sheath:core ratio of 50:50.

Sample 9: Sheath-core bicomponent fiber having a sheath: core ratio of 20:80. The sheath is formed from 94.3 wt. % polypropylene homopolymer having a MFR of about 35 g/10 min. available as ExxonMobil™ 3155E5; 5.0 wt. % calcium carbonate filler (FiberMaxx SCC 89695); 0.10 wt. % titanium dioxide (SCC 4837); and 0.6 wt. % blue pigment (SCC 11175). The core is formed from 90 wt. % polypropylene homopolymer having a MFR of about 15 g/10 min. (TOTAL LUMICENE® Polypropylene MR 2002); 10 wt. % calcium carbonate filler (FiberMaxx SCC 89695).

Sample 10: A sheath-core bicomponent fiber identical to that of Sample 9 but having a sheath:core ratio of 30:70.

Sample 11: A sheath-core bicomponent fiber identical to that of Sample 9 but having a sheath:core ratio of 50:50.

Sample 12: Sheath-core bicomponent fiber having a sheath:core ratio of 20:80. The sheath is formed from 94.3 wt. % polypropylene homopolymer having a MFR of about 35 g/10 min. available as ExxonMobil™ 3155E5; 5.0 wt. % calcium carbonate filler (FiberMaxx SCC 89695); 0.10 wt. % titanium dioxide (SCC 4837); and 0.6 wt. % blue pigment (SCC 11175). The core is formed from 85 wt. % polypropylene homopolymer having a MFR of about 15 g/10 min. (TOTAL LUMICENE® Polypropylene MR 2002); 15 wt. % calcium carbonate filler (FiberMaxx SCC 89695).

Sample 13: A sheath-core bicomponent fiber identical to that of Sample 12 but having a sheath:core ratio of 30:70.

Sample 14: A sheath-core bicomponent fiber identical to that of Sample 12 but having a sheath:core ratio of 50:50.

Sample 15: Sheath-core bicomponent fiber having a sheath:core ratio of 20:80. The sheath is formed from 84.3 wt. % polypropylene homopolymer having a MFR of about 35 g/10 min. available as ExxonMobil™ 3155E5; 15.0 wt. % calcium carbonate filler (FiberMaxx SCC 89695); 0.10 wt. % titanium dioxide (SCC 4837); and 0.6 wt. % blue pigment (SCC 11175). The core is formed from 85 wt. % polypropylene homopolymer having a MFR of about 15 g/10 min. (TOTAL LUMICENE® Polypropylene MR 2002); 15 wt. % calcium carbonate filler (FiberMaxx SCC 89695).

Sample 16: A sheath-core bicomponent fiber identical to that of Sample 15 but having a sheath:core ratio of 30:70.

Sample 17: A sheath-core bicomponent fiber identical to that of Sample 15 but having a sheath:core ratio of 50:50.

TABLE 1

| | Sheath | Core | Core | | | | MD Grab Tensile | | CD Grab Tensile | | Mean Tensile | Change |
|---|---|---|---|---|---|---|---|---|---|---|---|---|
| Trial Code | resin 3155 35 MFR | resin MR2002 15 MFR | resin 3155 35 MFR | Filler in Sheath % | Filler in Core % | BW [g/m^2] | Peak Load [gf] | Peak Stretch [%] | Peak Load [gf] | Peak Stretch [%] | Peak Load [gf] | From Control % |
| Sample 3 | 20 | 80 | | 5 | 0 | 25.9 | 10,284 | 58.8 | 6,744 | 69.6 | 8,328 | 21.7 |
| Sample 6 | 20 | 80 | | 5 | 5 | 26.25 | 9,834 | 57.2 | 6,781 | 72.7 | 8,166 | 19.3 |
| Sample 9 | 20 | 80 | | 5 | 10 | 27.11 | 10,061 | 59.4 | 6,240 | 70 | 7,923 | 15.8 |
| Sample 12 | 20 | 80 | | 5 | 15 | 26.56 | 9,232 | 58.2 | 6,620 | 76.9 | 7,818 | 14.2 |
| Sample 4 | 30 | 70 | | 5 | 0 | 26.27 | 9,508 | 56.8 | 5,993 | 66.5 | 7,549 | 10.3 |

TABLE 1-continued

| Trial Code | Sheath resin 3155 35 MFR | Core resin MR2002 15 MFR | Core resin 3155 35 MFR | Filler in Sheath % | Filler in Core % | BW [g/m^2] | MD Grab Tensile Peak Load [gf] | MD Grab Tensile Peak Stretch [%] | CD Grab Tensile Peak Load [gf] | CD Grab Tensile Peak Stretch [%] | Mean Tensile Peak Load [gf] | Change From Control % |
|---|---|---|---|---|---|---|---|---|---|---|---|---|
| Sample 7 | 30 | 70 | | 5 | 5 | 26.12 | 9,365 | 56.6 | 6,047 | 67.1 | 7,525 | 10 |
| Sample 2 | 20 (3155/ MR2002 20:80 blend) | 80 (3155/ MR2002 20:80 blend) | | 5 | 5 | 26.74 | 8,967 | 54.5 | 6,187 | 68.9 | 7,448 | 8.8 |
| Sample 8 | 50 | 50 | | 5 | 5 | 26.18 | 9,136 | 56.6 | 6,062 | 68.7 | 7,442 | 8.7 |
| Sample 14 | 50 | 50 | | 5 | 15 | 25.59 | 9,155 | 56.5 | 6,039 | 70.6 | 7,435 | 8.6 |
| Sample 5 | 50 | 50 | | 5 | 0 | 25.69 | 9,138 | 55.6 | 6,028 | 68.4 | 7,422 | 8.4 |
| Sample 15 | 20 | 80 | | 15 | 15 | 26.18 | 6,125 | 74.8 | 8,607 | 59.2 | 7,261 | 6.1 |
| Sample 10 | 30 | 70 | | 5 | 10 | 26.49 | 9,161 | 55.4 | 5,720 | 67.7 | 7,238 | 5.8 |
| Sample 13 | 30 | 70 | | 5 | 15 | 26.25 | 9,084 | 58.7 | 5,757 | 68.3 | 7,231 | 5.7 |
| Sample 14 | 50 | 50 | | 5 | 15 | 26.39 | 8,686 | 57.1 | 5,771 | 68.2 | 7,080 | 3.4 |
| Sample 17 | 50 | 50 | | 15 | 15 | 26.12 | 5,816 | 72.5 | 8,320 | 57.5 | 6,956 | 1.6 |
| Control | 20 | | 80 | 0 | 0 | 26.64 | 8,233 | 52.7 | 5,689 | 64.4 | 6,844 | 0 |
| Sample 1 | 20 | | 80 | 5 | 5 | 26.27 | 7,717 | 51.5 | 5,042 | 65 | 6,238 | −8.9 |

As indicated in Table 1 above, all of the fibers of the present invention having a blend of high-MFR polypropylene, low-MFR polypropylene and calcium carbonate filler exhibited improved tensile strength compared to the Control fiber having no calcium carbonate filler or low-MFR polypropylene. Further, Samples 3, 6, 9 and 12 each having 5 wt. % calcium carbonate filler in the sheath layer based on the total weight of the sheath layer exhibited the greatest improvement in tensile strength as compared to the control fiber.

Notably, Sample 1, comprising 35 MFR polypropylene and 5 wt. % calcium carbonate filler based on the total weight of the fiber, was the only test fiber that exhibited a decrease in tensile strength compared to the Control fiber, which comprised the same 35 MFR polypropylene and no calcium carbonate filler. In contrast, each of the sample fibers that included both the low-MFR (15 MFR) polypropylene and the higher-MFR (35 MFR) polypropylene exhibited improved tensile strength compared to the control, with the Sample 2 exhibited nearly 9% higher tensile strength compared to the control. Without intending to be bound by any particular theory, the present inventors have found that including both the higher-MFR polymer and the lower-MFR polymer can help the thermal bonding of the filaments in the spunbond web while maintaining, or even increasing, the filament strength.

Moreover, in comparison to the bicomponent fibers having identical sheath and core compositions (i.e., the Control, Sample 1 and Sample 2), which generally approximate the properties of a monofilament having the same composition, the bicomponent fibers having pigment in only the sheath layer require less pigment overall in the composition of the fibers. The color pigment is only present in the sheath layer of the bicomponent fibers, as described above. For instance, when the pigment is present in an amount of 0.6 wt. % based on the total weight of the sheath layer, and the sheath:core ratio is 20:80, the pigment is only present in a total amount of 0.12 wt. % based on the total weight of the fiber. Even when the sheath:core ratio is 50:50, when the pigment is present in an amount of 0.6 wt. % based on the total weight of the sheath layer, the pigment is only present in a total amount of 0.3 wt. % based on the total weight of the fiber. Compared to the Control, which includes 0.82 wt. % pigment based on the total weight of the fiber, the bicomponent fibers can use only about 15% to about 40% of the amount of pigment included in the Control fiber (i.e., 60%-85% less pigment is required for the bicomponent fibers compared to the Control).

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An article comprising:

a nonwoven web material, the nonwoven web material comprising bicomponent fibers having a sheath-core arrangement comprising a sheath and a core, wherein the fibers comprise a first polymer, a second polymer and a filler, wherein the first polymer is a polyolefin, the second polymer is a polyolefin having a lower melt flow rate (MFR) than the first polymer, and the filler is calcium carbonate ($CaCO_3$), wherein the filler is present only in the sheath of the bicomponent fibers, wherein the sheath further comprises at least one color pigment present in an amount in a range from about 0.05 wt. percent to about 1 wt. percent based on the total weight of the sheath, wherein the nonwoven web material has a tensile strength greater than 7000 grams-force, and wherein the article comprises a medical product, a surgical product, a personal protective product, and/or industrial garment.

2. The article of claim 1, wherein the first polymer is a polypropylene, and the second polymer is a polypropylene having a lower MFR than the first polymer.

3. The article of claim 1, wherein the filler is present in the fibers in an amount in a range from about 0.5 wt. percent to about 30 wt. percent based on the total weight of the fibers.

4. The article of claim 1, wherein the filler is present in the fibers in an amount in a range from about 1 wt. percent to about 20 wt. percent based on the total weight of the fibers.

5. The article of claim 1, wherein the filler is present in the fibers in an amount in a range from about 2 wt. percent to about 15 wt. percent based on the total weight of the fibers.

6. The article of claim 1, wherein the sheath comprises the first polymer.

7. The article of claim 1, wherein the core is free from the first polymer.

8. The article of claim 1, wherein the core comprises the second polymer.

9. The article of claim 1, wherein the fibers further comprise titanium dioxide ($TiO_2$).

10. The article of claim 9, wherein the titanium dioxide is present in an amount greater than 0 wt. percent and less than about 0.2 wt. percent based on the total weight of the fibers.

11. The article of claim 1, wherein the nonwoven web material is formed as at least one layer of a laminate material.

12. The article of claim 1, wherein the medical product, surgical product, personal protective product, and/or industrial garment comprises a sterilization material.

13. The article of claim 1, wherein the medical product, surgical product, personal protective product, and/or industrial garment comprises a personal protective garment.

14. The article of claim 1, wherein the calcium carbonate mean particle size is in a range from about 0.5 microns to about 20 microns.

15. An article comprising:

a nonwoven web material, the nonwoven web material comprising bicomponent fibers having a sheath-core arrangement comprising a sheath and a core, wherein the fibers comprise a first polymer, a second polymer and a filler, wherein the first polymer is a polyolefin, the second polymer is a polyolefin having a lower melt flow rate (MFR) than the first polymer, and the filler is calcium carbonate ($CaCO_3$), wherein the filler is present in the sheath, wherein the filler is present in the core in an amount in a range from about 5 wt. percent to about 15 wt. percent based on the total weight of the core, wherein the nonwoven web material has a tensile strength greater than 7000 grams-force, the sheath further comprising at least one color pigment in an amount in a range from about 0.05 wt. percent to about 1 wt. percent based on the total weight of the sheath, and wherein the article comprises a medical product, a surgical product, a personal protective product, and/or industrial garment.

* * * * *